United States Patent [19]

Imai

[11] Patent Number: 4,458,515

[45] Date of Patent: Jul. 10, 1984

[54] METHOD AND APPARATUS FOR VARIABLY CONTROLLING TRANSVERSE RIGIDITY OF ROLLING MACHINE

[75] Inventor: Isao Imai, Yokohama, Japan

[73] Assignee: Ishikawajima-Harima Jukogyo Kabushiki Kaisha, Tokyo, Japan

[21] Appl. No.: 374,414

[22] Filed: May 3, 1982

[51] Int. Cl.[3] ..... B21B 37/08; B21B 31/32

[52] U.S. Cl. ..... 72/20; 72/243; 364/472

[58] Field of Search ..... 72/6, 19, 20, 243; 364/472

[56] References Cited

U.S. PATENT DOCUMENTS 3,793,859 2/1974 Sterrett et al. ..... 72/20

FOREIGN PATENT DOCUMENTS 55-109509 8/1980 Japan ..... 72/243
55-109510 8/1980 Japan ..... 72/243
56-39102 4/1981 Japan ..... 72/243
1196155 6/1970 United Kingdom ..... 72/6

*Primary Examiner*—Lowell A. Larson
*Assistant Examiner*—Jorji M. Griffin

[57] ABSTRACT

In a sheet rolling mill having work rolls and backup rolls, rolling of flat sheets is facilitated by controlling constant the transverse rigidity or deflection in the direction of width of rolls. The rolling force is detected, and based on the rolling force thus detected, the value for correcting the crown of the work roll is calculated by a transverse rigidity coefficient and a function determined by sheet thickness to control the transverse rigidity.

4 Claims, 11 Drawing Figures

METHOD AND APPARATUS FOR VARIABLY CONTROLLING TRANSVERSE RIGIDITY OF ROLLING MACHINE

BACKGROUND OF THE INVENTION

The transverse rigidity of rolling mills is a concept expressing the deflection in the direction of the width of roll by the rolling force and is defined by the formula Q=Rolling force/Sheet crown (in ton/mm).

This transverse rigidity Q is subject to change by the sheet width, as shown in FIG. 1. The bending effect coefficient $K_B$ is also subject to change by the sheet width, as illustrated. Thus, it is difficult to obtain a precise relationship between the rolling force $P_R$ and the roll bending force $P_B$.

If the transverse rigidity is always kept at an optimum value regardless of the sheet width, the sheet crown can be reduced to minimum against disturbance of the rolling force or heat crown and roll wear.

This principle will now be described with reference to FIG. 2 (which presents the rolling force along the vertical axis and the crown variation along the horizontal axis).

As shown in FIG. 2(*a*), if the transverse rigidity is increased as $Q_1 \rightarrow Q_2$ against increase of the rolling force ($P_{R1} \rightarrow P_{R2}$), it is possible to maintain the relative crown at a constant value for rolling. Also, as shown in FIG. 2(*b*), if the transverse rigidity is reduced as $Q_1 \rightarrow Q_3$ against the heat crown $C_H$, rolling with a constant relative crown is enabled. Further, in rolling of the input sheet crown at zero, if the tranverse rigidity is increased infinitely as $Q \rightarrow Q_\infty$ as shown in FIG. 2(*c*), there will be required a decrease bending d to correspond to the heat crown, and such is not practical. But, in such case, if an adequate transverse rigidity (say, $Q_3$) is given to the rolling mill, it is possible to control the sheet crown against the heat crown within the range of the increase bending I so that it is enabled to roll a sheet of flat crown with ease.

So far, as one of the means of variable control of the rolling mill, it has been contempleted to change the contact width of the work roll with the sheet and that of the buckup roll with the work roll. As a practical method, it has been disclosed to maintain the horizontal position of the upper and lower intermediate rolls of the rolling mill at a certain proportion to the sheet width (See Japanese Patent Public Disclosure Nos. 41255/1974 and 30777/1975 and Japanese Patent Publication No. 19510/1975). However, such a method has a shortcoming of causing an adverse effect to the sheet thickness accuracy in that change of the contact width of the backup roll with the work roll induces great change of the vertical rigidity which is inherently critical in the rolling mills.

This invention is intended to offer a transverse rigidity control method and apparatus which permit to maintain the transverse rigidity of the rolling mill at constant value regardless of the sheet width and control the transverse rigidity alone without affecting the vertical rigidity.

The present invention will be described in detail with reference to the accompanying drawings.

DESCRIPTION OF THE PREFERRED EMBODIMENTS

The present invention is based on the principle set forth in the following.

First, the relation between the transverse rigidity of a rolling mill and the crown disturbance is considered as below:

$$Cr = \frac{P_R}{Q} - \left(C^* + \frac{R_B}{K_B}\right) \tag{1}$$

$$C^* = C_H - C_W + C_I$$

where

Q: Transverse regidity (ton/mm);

$P_R$: Rolling force (ton);

Cr: Output-side sheet crown (mm);

$C_W$: Roll wear (mm);

$C_I$: Initial crown (mm);

$P_B$: Roll bending force (ton); and $K_B$: Bending effect coefficient (ton/mm).

From the foregoing formulas, it will be sseen that the outputside sheet crown Cr is determined by the rolling mill transverse rigidity, rolling force, shape of roll and roll bending force.

Here, the roll bending force $P_B$ is expressed by the formula $$P_B = C\frac{K_B}{Q}P_R \tag{2}$$

Substituting this roll bending force for $P_B$ in formula (1), $$Cr = \frac{(1-C)}{Q}P_R - C^* \tag{3}$$

$$= \frac{P_R}{\frac{Q}{(1-C)}} - C^*$$

-continued $$= \frac{P_R}{Qe} - C^* \quad (4)$$

$$Qe = \frac{Q}{1 - C} \quad (5)$$

By controlling in this way, there is obtained a controlled equivalent transverse rigidity Qe.

In the foregoing formulas, C represents the transverse rigidity control coeffecient, and when C=1, Qe=∞;

when C=0, Qe=Q; or when C=−∞, Qe=0.

Thus, it is enabled to impart a desired transverse rigidity.

Figure 1:
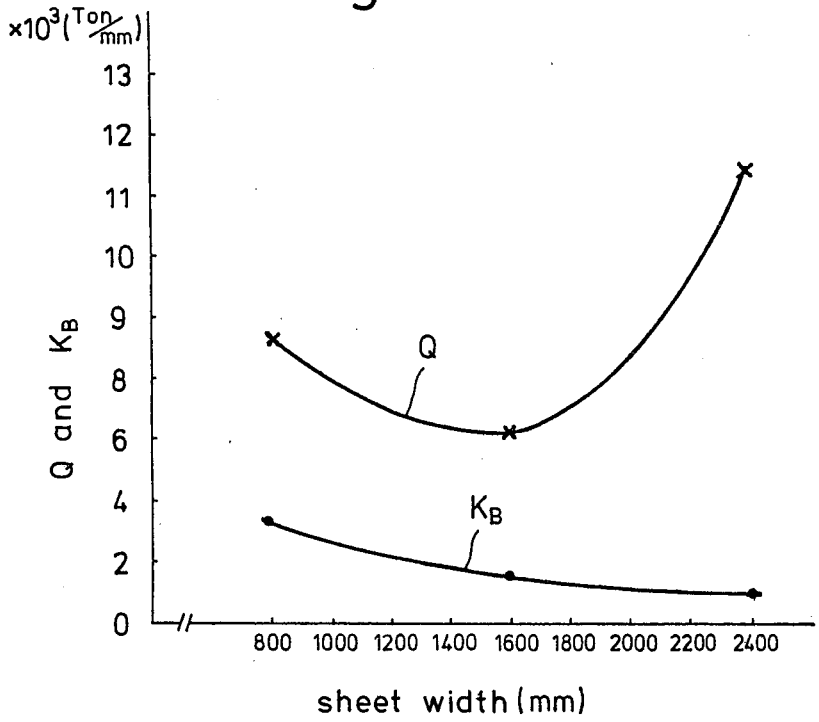
FIG. 1 is a diagram showing the relationship of the transverse rigidity to the sheet width and that of the bending effect coefficient to the sheet width.
Figure 3:
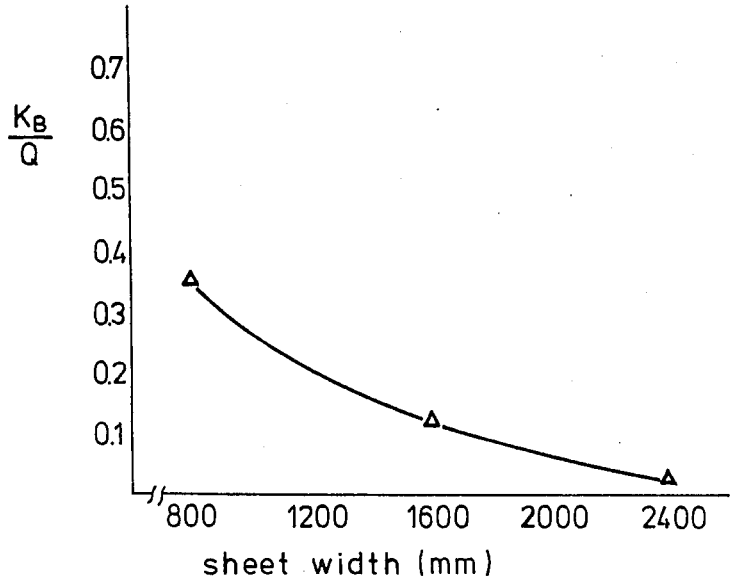
FIG. 3 is a diagram showing the ratio of the transverse rigidity to the bending effect coefficient as a function of the sheet width.
Figure 2:
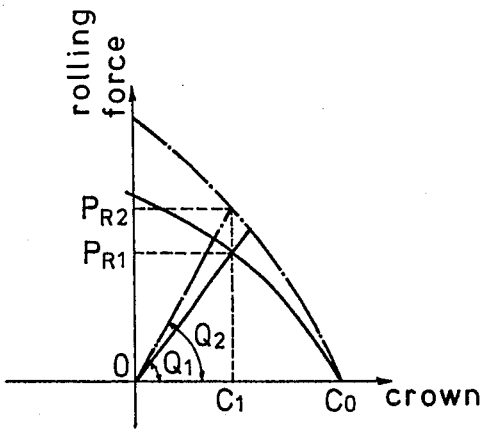
FIGS. 2(*a*), 2(*b*) and 2(*c*) are diagrams showing the effects of the transverse rigidity respectively.
Figure 2:
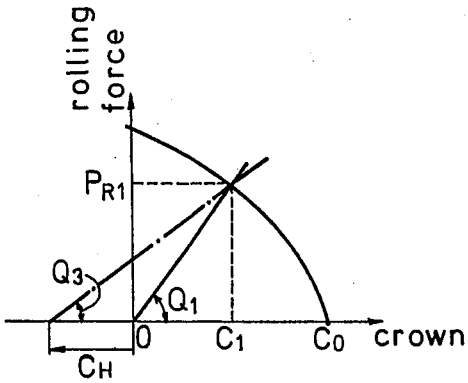
Figure 2:
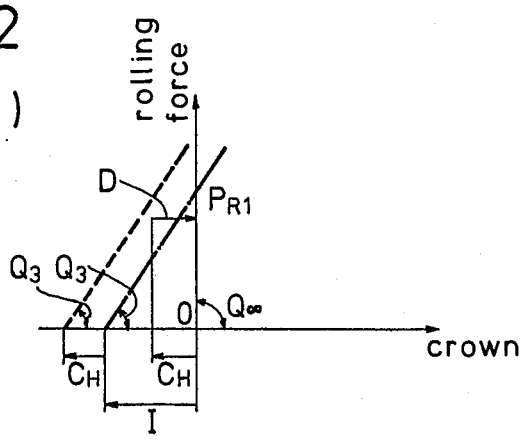

In formula (2) above, $K_B/Q$ shows a proportion of the bending force for correction of the roll deflection due to the rolling force, and its example is illustrated in FIG. 3. In this case, the strip width is known before the rolling so that the rolling is made with an appropriate value of $K_B/Q$ chosen for the sheet width and an adequate value set for the transverse rigidity control coefficient C depending on the condition of rolling. In this way, it is enabled to control the transverse rigidity to an optimum value for the sheet width. It is also possible to maintain the transverse rigidity at a constant value regardless of the sheet width.

Figure 4:
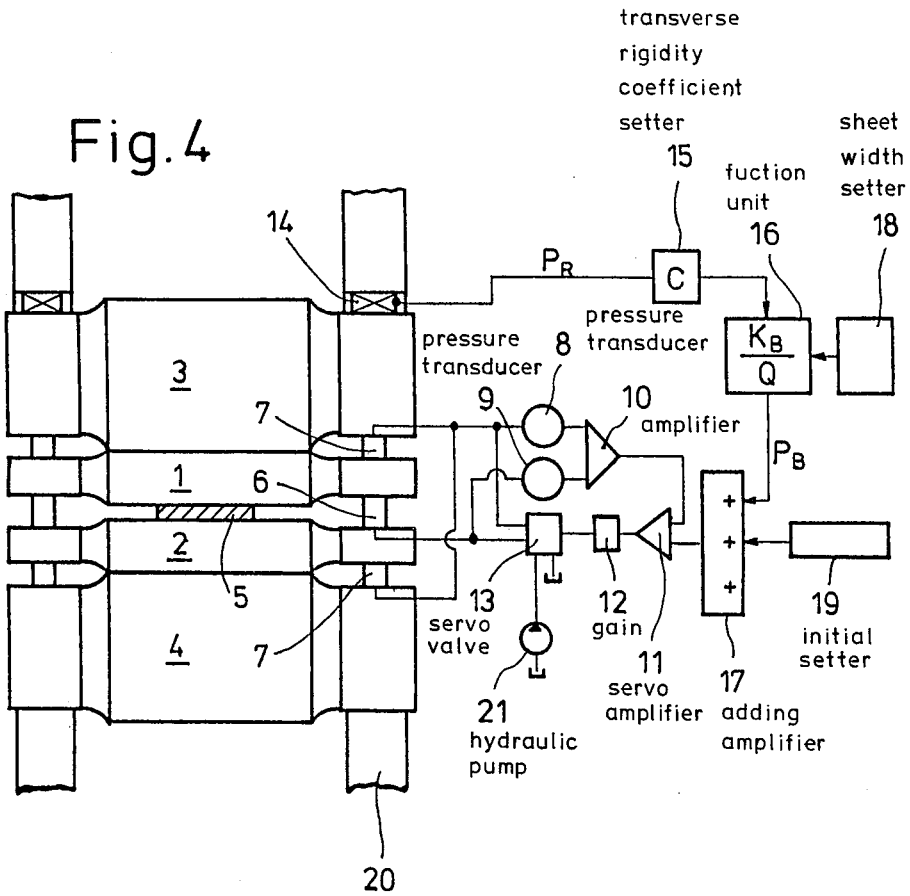
FIG. 4 is a block diagram showing an embodiment of the apparatus for variably controlling the transverse rigidity according to the present invention.

Accroding to the foregoing principle, the transverse rigidity control apparatus is constructed as shown in FIG. 4.

In FIG. 4, reference numerals 1 and 2 represent work rolls; 3 and 4, buckup rolls; and 5, a sheet. Between the journal boxes of the work rolls 1 and 2 is provided an increase bender 6, and between the journal boxes of the work rolls 1 and 2 and those of the backup rolls 3 and 4 are provided decrease benders 7 respectively. These benders have a hydraulic pressure applied so that the work rolls 1 and 2 are bent in the form of a convex or concave curve by the differential pressure. These bending pressures are detected by pressure transducers 8 and 9, and the differential pressures are taken by an amplifier 10, fed back and added by a servo amplifier 11 to give a gain 12 for control by a servo valve 13.

On the other hand, the rolling force $P_R$ is detected by a load cell 14 and is inputted through a transverse rigidity coefficient setter 15 and a function unit 16 to an adding amplifier 17 as a roll bending force $P_B$. The function unit has a function $K_B/Q$ (See FIG. 3) commensurate with the sheet width given by a signal from a sheet width setter 18, while the transverse rigidity coefficient setter 15 has a constant transverse rigidity coefficient C set, and these are adapted to cooperate to give an output of optimum gain 12 from the servo amplifier 11. Setting of an external roll bending force is made by an initial setter 19.

In FIG. 4, reference numeral 20 represents a housing; and 21, a hydraulic pump.

Figure 5:
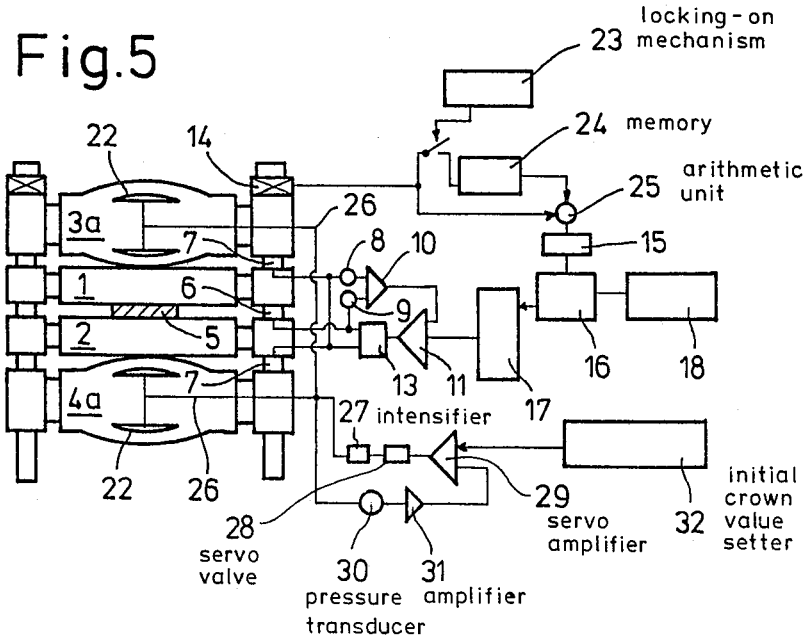
FIG. 5 is a block diagram showing another embodiment of the apparatus for variably controlling the transverse rigidity according to the present invention.

FIG. 5 shows another embodiment of the present invention, using a surface profile variable roll (Vc roll) for each backup roll.

The backup rolls 3a and 4a have respectively a hydraulic chamber 22 at the central part, and by applying a hydraulic pressure to the hydraulic chamber 22, the surface profile can be changed, and this furface profile changes (expands of shrinks) in proportion to the hydraulic pressure.

Where rolling is made with such backup rolls 3a and 4a incorporated, the initial crown in C* in formula (4) is given by the buckup rolls 3a and 4a so that the bending control is made in accordance with the prospected value of the rolling force and the sheet width.

The increment or decrement of wheet crown ΔCr in formula (4) is obtainable as below.

$$\Delta Cr = \frac{\Delta P}{\Delta Q} - \Delta C^* \quad (6)$$

$$\Delta C^* = 0$$

$$\Delta Cr = \frac{\Delta P}{Qe} \quad (7)$$

Figure 6:
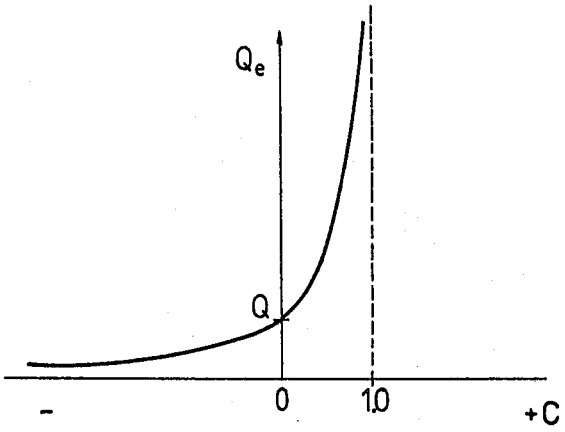
FIG. 6 is a diagram showing a curve of change of the transverse rigidity under the present invention.

That is, with an initial roll crown value given to the backup rolls and locked on at an adequate sheet crown value, the transverse rigidity is controlled with reference to such point. The transverse rigidity Qe thus controlled is constant regardless of the sheet width and can take a desired value accordingly to the transverse rigidity coefficient, as shown in FIG. 6.

Specifically, the signal of the rolling force at the time when the initial crown value is given by the backup rolls 3a and 4a to the work rolls 1 and 2 is locked on by a locking-on mechanism 23 and stored in a memory 24, and the signal from the load cell 14 is compared with the signal from said memory 24 by an arithmetic unit 25 to obtain the difference and thus know the rolling force by the differential signal. Further, in order to give a specified crown to the backup rolls 3a and 4a, there are provided an oil passage 26 to the hydraulic chamber 22, an intensifier 27 and a servo valve 28 in said oil passage 26, a servo amplifier 29 generating a required signal to said servo valve 28 and a pressure transducer 30 detecting the hydraulic pressure in the hydraulic chamber 22, with the signal coming out of said pressure transducer 30 fed across an amplifier 31 back to the servo amplifier 29 to set an initial crown value by an initial crown valve setter 32 in the servo amplifier 29 so that an initial crown is given to the backup rolls 3a and 4a.

In the foregoing case where Vc rolls are used for the buckup rolls, if the profile diametric increment of the backup roll at the strip width is represented by $C_B$, the coefficient of effect αv onto the sheet crown Cr is given by $$\alpha v = Cr/C_B \quad (8)$$

$$C_B = \beta Pv \quad (9)$$

Figure 7:
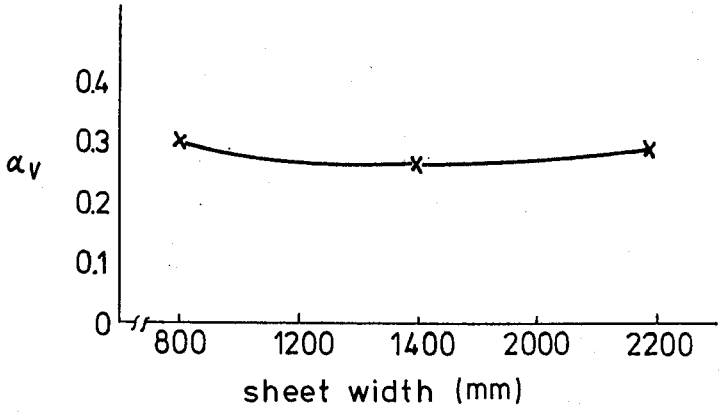
FIG. 7 is a diagram showing a curve of the coefficient of effect on the sheet crown when buckup rolls and Vc rolls are used under the present invention.

As stated above, the hydraulic force Pv and the buckup roll diametric crown $C_B$ are in a proportional relationship to each other, and its coefficient β is approximated by a square function of the sheet width. As FIG. 7 indicates, the effect coefficient αv as a function of the sheet width shows a constant value if the hydraulic force Pv is constant.

Figure 8:
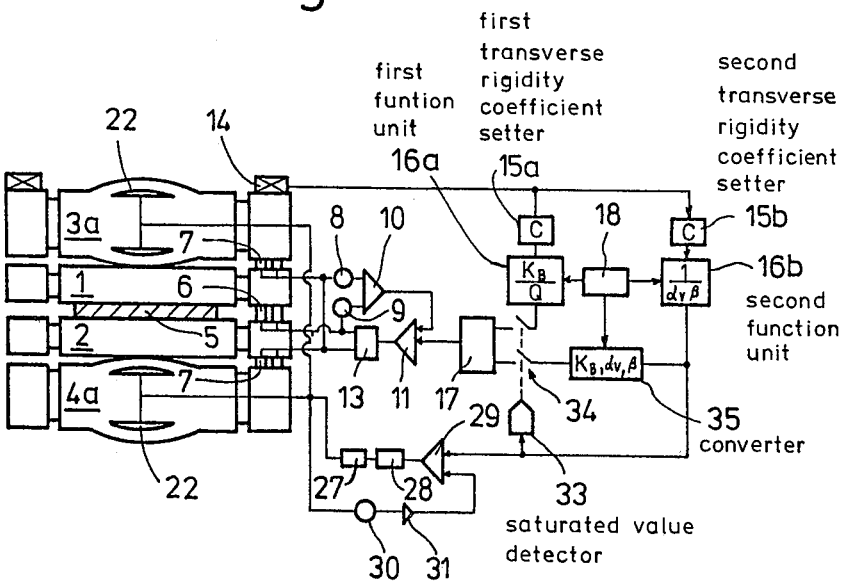
FIGS. 8 and 9 show respectively a block diagram of a still another embodiment of the apparatus for variably controlling the transverse rigidity according to the present invention.

FIG. 8 shows a further embodiment of the control with bender interlocked with the buckup roll internal pressure. The principle in such embodiment will now be described in the following.

Where Vc rolls are used as the buckup rolls, the sheet crown against the changing rolling force is given by the formula $$Cr = \frac{P_R}{Q} - \left(\alpha v\beta + \frac{P_B}{K_B}\right) \quad (10)$$

In this case, the hydraulic force Pv of the backup roll is obtainable by $$Pv = \frac{CP_R}{\alpha v\beta Q}$$

so that the sheet crown is given by $$Cr = \frac{\left(1 - \frac{C}{\alpha v\beta}\right) P_R}{Q} - \frac{P_R}{K_B}$$

Here, the transverse rigidity is controlled as $$Qe = \frac{Q}{\left(1 - \frac{C}{\alpha v\beta}\right)}$$

for $P_B=0$ by changing the Pv value.

However, if the absolute value of bending by the rolling force is great enough over the value of the backup roll diametric crown by the hydraulic force Pv, control is so made as to add the bender force with $Pv_{max}$ maintained to satisfy the transverse rigidity control. That is, according to this system, the rolling force having that part which is converted to the value of the hydraulic pressure Pv subtracted is given as a quantity for adjustment of the bender, and the system is expressed by the formula $$\Delta P_R = P_R - P_{Rc}$$
$$= P_R - \left(\frac{1}{C}\alpha v\beta Pv\right)$$

The value of $\Delta P_R$ thus obtained may be corrected on the bender, or $$P_{BO} = K_B\alpha v\beta Pv$$

may be deducted from the $P_B$ value calculated from the rolling force for use as a set value of the bender.

The control apparatus according to such system will be described with reference to FIG. 8. The backup rolls 3*a* and 4*a* have respectively a hydraulic chamber 22 at the central part of the roll, as in the case of FIG. 5, so that the surface profile can be changed by applying a hydraulic pressure to said hydraulic chamber 22, and the surface profile is adapted to change in proportion to the hydraulic force applied. This hydraulic pressure (internal pressure) is given by the servo valve 28 and the intensifier 27, and it is fed back to the servo amplifier 29 via the pressure transducer 30 and the amplifier 31.

On the other hand, the signal of rolling force $P_R$ detected by the load cell 14 is inputted through a first transverse rigidity coefficient setter 15*a* and a first function unit 16*a* having a function of $K_B/Q$ to the adding amplifier 17. Here, the backup roll internal pressure setting force Pv to be inputted to the servo amplifier 29 is calculated as the signal of the rolling force $P_R$ detected by the load cell 14 passes through a second transverse rigidity coefficient setter 15*b* and a second function unit 16*b* having a function of $1/\alpha v\beta$. The function $K_B/Q$ in the first function unit 16*a* and the function $1/\alpha v\beta$ in the second function unit 16*b* are determined by the sheet width, and the signal of the value of sheet width from the sheet width setter 18 is given to the first and second function units 16*a* and 16*b*. Further, there is provided a saturated value detector 33 which detects the backup roll internal pressure set value has reached a saturated value. When the saturation detector 33 detects a saturated value, a switch 34 is actuated to introduce the signal passing through the first function unit 16*a* into the adding amplifier 17 so that the control shown in FIG. 4 operates as a transverse rigidity control loop. Simultaneously, the signal passing through the second function unit 16*b* is introduced through a converter 35 into the adding amplifier 29. This converter is to deduct the initial crown components of the backup rolls 3*a* and 3*b* and has $K_B\alpha v\beta$ set as a function. This funtion is also subject to change by the sheet width.

The rolling force may be stored and locked on at the point at which the internal pressures of the backup rolls 3*a* and 4*a* have reached saturation so that the transverse rigidity control loop is operated as shown in FIG. 5. Further, the control of the internal pressure and that of the bender pressure may be used jointly. In such a case, control is not made by detecting the saturation of the internal pressure but by distributing the change of the rolling force proportionally to the internal pressure and the bender pressure.

Figure 9:
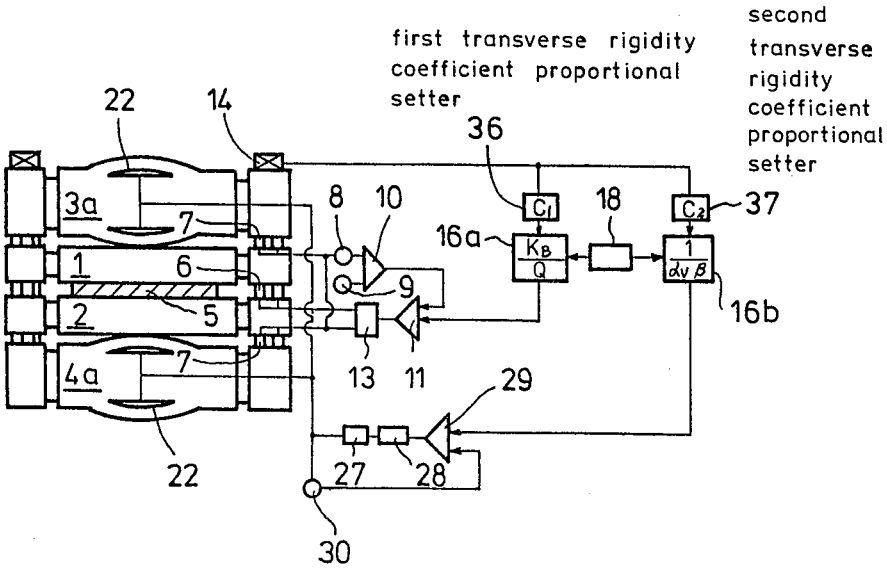

That is, the sheet crown is controlled as $$Cr = \frac{P_R}{Q} - \frac{C_1 P_R}{\alpha v\beta Q} - \frac{C_2}{Q} P_R$$

while the transverse rigidity controlled as $$\therefore Qe = \frac{Q}{\left(1 - \frac{C_1}{\alpha v\beta} - C_2\right)}$$

$$\because P_B = \frac{C_2 K_B}{Q} P_R$$

$$Pv = \frac{C_1}{\alpha v\beta Q} P_R$$

so that by giving a proportion of the transverse rigidity coefficients $C_1$ and $C_2$, it is enabled to control the equivalent transverse rigidity. This block diagram is shown in FIG. 9. In FIG. 9, reference numeral 36 represents a first transverse rigidity coefficient proportional setter; and 37, a second transverse rigidity coefficient proportional setter. In FIGS. 8 and 9, the same members are shown by the same reference numerals.

The effects and advantages of the present invention may be summarized as follows.

(i) The transverse rigidity can be controlled at a constant value against change of the sheet width.

(ii) The trnasverse rigidity thus controlled can be set at a desired value.

(iii) The system is practicable on four-stage rolling mills, with no change in the contact width between the buckup roll and the work roll, so that the vertical rigidity does not change even if the transverse rigidity is changed, ensuring no adverse effect on the accuracy of sheet thickness.

(vi) Variable control of the transverse rigidity is made by control apparatus so that the machine can be simplified and that the manufacturing cost can be reduced.

(v) Compared with six-stage rolling mill intermediate roll moving systems for transverse rigidity variable control of this type, the present invention has advantages of less number of rolls, less wearing of the rolls and lower running cost. Also, it is composed of a four-stage rolling mill of good symmetry so that it is free from zig-zag movement of the sheet.

What is claimed is:

1. An apparatus for variably controlling transverse rigidity of a sheet rolling mill having work rolls and backup rolls comprising a decrease bender, an increase bender, bender control means having a bending force setting signal input for controlling said benders upon said signal, and roll bending force setting means for setting a roll bending force in said bender control means, said roll bending force setting means including a rolling force detecting means, a transverse rigidity coefficient setter for setting a transverse rigidity coefficient of the rolling mill, a function unit having a function determined by sheet width and a sheet width setter for transmitting a signal of a sheet width value to said function unit, thereby calculating roll bending force by multiplying said transverse rigidity coefficient and said function to a rolling force detected by said rolling force detecting means, wherein said bender control means comprises valve means for controlling a bender working fluid, a servo amplifier having a roll bending force setting signal input for, based on such signal, transmitting a control signal to said value means, and a feedback circuit for detecting a working fluid pressure in the bender and feeding the same back to said servo amplifier, and wherein a hydraulic chamber is provided in each backup roll so that the surface profile can be changed by controlling the hydraulic pressure in said hydraulic chamber; means for controlling a backup roll internal pressure for change of surface profile by controlling hydraulic pressure of the hydraulic chamber and means for setting an internal pressure of the backup rolls, said internal pressure setting means including a second transverse rigidity coefficient setter, a second function unit and a sheet width setter for sending a signal of the value of sheet width to said second function unit, a backup roll internal pressure set value being calculated from the rolling force by a second transverse rigidity coefficient and a second function, thereby controlling the transverse rigidity of the rolling mill by using the backup roll internal pressure set value and the roll bending force jointly.

2. An apparatus according to claim 1 wherein the rolling force detecting means comprises a rolling force detector, means for locking on and storing a rolling force signal and an arithmetic unit for comparing the rolling force signal detected by said rolling force detector with the rolling force signal stored in said device and outputting a differential signal as a correction rolling force signal.

3. An apparatus according to claim 1 wherein said backup roll internal pressure setting means further comprises a saturation value detector for detecting the saturation value of the backup roll internal pressure so that when the backup roll internal pressure reaches a saturation value, a roll bending force setting signal is inputted to the bender control means.

4. An apparatus according to claim 1 wherein the difference between the stored value of the rolling force and the actual rolling force at the time of saturation of the backup roll internal pressure is used as a correction rolling force signal.

* * * * *